US009593604B2

(12) United States Patent
Gstrein

(10) Patent No.: US 9,593,604 B2
(45) Date of Patent: Mar. 14, 2017

(54) LUBRICATING OIL SYSTEM FOR A COMBUSTION ENGINE, IN PARTICULAR FOR INDUSTRIAL AND COMMERCIAL VEHICLES

(71) Applicant: FPT Motorenforschung AG, Arbon (CH)

(72) Inventor: Wolfgang Gstrein, Bergenz (AT)

(73) Assignee: FPT MOTORENFORSCHUNG AG, Arbon (CH)

( * ) Notice: Subject to any disclaimer, the term of this patent is extended or adjusted under 35 U.S.C. 154(b) by 0 days.

(21) Appl. No.: 14/753,319

(22) Filed: Jun. 29, 2015

(65) Prior Publication Data

US 2016/0003114 A1 Jan. 7, 2016

(30) Foreign Application Priority Data

Jul. 1, 2014 (EP) ..... 14175218

(51) Int. Cl.
*F01M 1/16* (2006.01)
*F01M 1/02* (2006.01)

(52) U.S. Cl.
CPC ..... *F01M 1/16* (2013.01); *F01M 1/02* (2013.01)

(58) Field of Classification Search
CPC ... F01M 1/16; F04C 2/102; F01L 9/02; F16H 61/4017
USPC ..... 701/36; 123/196 AB, 90.12; 417/278; 60/468
See application file for complete search history.

(56) References Cited

U.S. PATENT DOCUMENTS 4,887,428 A * 12/1989 Iino ..... F16H 61/4017 60/468
5,339,776 A 8/1994 Regueiro
2002/0083915 A1* 7/2002 Choi ..... F01M 1/16 123/196 AB
2002/0172604 A1 11/2002 Berger
2004/0136838 A1* 7/2004 Resh ..... F04C 2/102 417/278
2007/0079781 A1* 4/2007 Gaessler ..... F01L 9/02 123/90.12
2008/0308354 A1* 12/2008 Gratzer ..... B60K 17/344 184/6.12
2013/0068194 A1* 3/2013 Brennan ..... F02D 13/08 123/321
2015/0033756 A1* 2/2015 Lazzeri ..... F02C 7/12 60/782

FOREIGN PATENT DOCUMENTS

EP 1693553 A2 8/2006
JP H0417708 1/1992
JP H05195741 8/1993
JP H0610635 1/1994
WO WO2012176736 12/2012

* cited by examiner

*Primary Examiner* — Yuri Kan
(74) *Attorney, Agent, or Firm* — Stetina Brunda Garred and Brucker

(57) ABSTRACT

Lubricating oil system for a combustion engine, in particular for industrial or commercial vehicles, the system comprising a bypass connection suitable to bypass an oil pump associated to an engine oil circuit, a controllable valve suitable to adjust an amount of oil to be bypassed through the bypass connection, control means controlling the controllable valve, programmed to control said controllable valve as a function of the combustion engine speed.

12 Claims, 2 Drawing Sheets

LUBRICATING OIL SYSTEM FOR A COMBUSTION ENGINE, IN PARTICULAR FOR INDUSTRIAL AND COMMERCIAL VEHICLES

CROSS REFERENCE TO RELATED APPLICATIONS

The present application claims priority to European Patent Application No. 14175218.8 filed Jul. 1, 2014, the entirety of the disclosures of which are expressly incorporated herein by reference.

STATEMENT RE: FEDERALLY SPONSORED RESEARCH/DEVELOPMENT

Not Applicable.

FIELD OF THE INVENTION

The present invention relates to a lubricating oil system for a combustion engine, in particular for industrial and commercial vehicles. Moreover, the present invention, relates to an engine braking system associated to said lubricating oil system, a method for adjusting an oil pressure in a lubricating oil system of a combustion engine, and commercial or industrial vehicles comprising a combustion engine implementing said oil lubricating system.

DESCRIPTION OF THE PRIOR ART

The lubricating oil system drains power from the combustion engine in order to execute its task to pump the oil through the several components of the combustion engine, in order to lubricate the components subjected to frictions and to cool the pistons.

The oil pumps usually are suitable to reach pressures of 4-6 bar, that could be high in comparison with normal operative conditions. In addition, the pressure within the oil circuit can change according to the oil temperature, that influences the oil viscosity.

For this reason a bypass path is usually provided coupled with a loaded spring valve in order to limit the oil pressure.

In order to limit the power drained by the combustion engine, it is known the possibility to implement variable displacement pumps, suitably to adapt the oil pressure according to the operative condition of the engine.

This task is usually reached by varying the pump geometry or by controlling its speed.

However, the variable pump have a really high cost in comparison with the traditional (non-controllable) pumps and, in addition, they show a high sensitivity to the impurity contained in the oil itself. Indeed, the variable oil pumps are much more sensitive to oil contamination and installation due to possible block/bedplate misalignments. In addition, their durability for 1.6 mio. km is not yet proven.

Therefore, the implementation of variable pump implies the increasing of the engine managing costs in spite of theoretical reduction of fuel consumption and pollutant emission.

SUMMARY OF THE INVENTION

Therefore it is the main object of the present invention to provide a lubricating oil system for a combustion engine, in particular for industrial and commercial vehicles, which overcomes the above problems/drawbacks.

In particular the system of the proposed invention is suitable to reduce the fuel consumption, by maintaining a high reliability of the combustion engine as a whole.

The main principle of the invention is the implementation of a bypass path through a controllable valve, whose state is controlled as a function of the engine speed and load.

Thanks to the present invention the pump can be a traditional oil pump, namely a non-controllable pump, associated with the engine lubricating oil circuit.

Nevertheless, a variable pump can be associated with the present invention in order to improve the responsiveness of a variable pump.

Preferably, such function implements a run-time engine model in order to calculate an expected oil pressure within the oil lubricating circuit or a map having as first input the engine speed, as second input the engine BMEP (brake mean effective pressure) and as output said expected oil pressure in the oil lubricating circuit.

The BMEP value to enter said map can be obtained in several known ways.

According to a preferred embodiment of the invention, the controllable valve state is adjusted according to a pressure feedback signal acquired in a point of the lubricating oil circuit.

Advantageously, the losses through the bypass path are small in comparison with the losses through the combustion engine, therefore, energy spent to circulate the oil through the bypass path is small too and the system shows nearly the same energy consumption behavior as a variable pump system, without its drawbacks.

These and further objects are achieved by means of the attached claims, which describe preferred embodiments of the invention, forming an integral part of the present description.

BRIEF DESCRIPTION OF THE DRAWINGS

The invention will become fully clear from the following detailed description, given by way of a mere exemplifying and non limiting example, to be read with reference to the attached drawing figures, wherein.

The same reference numerals and letters in the figures designate the same or functionally equivalent parts.

According to the present invention, the term "second element" does not implies the presence of a "first element", first, second, etc. are used only for improving the clarity of the description and should not be interpreted in a limiting way.

DETAILED DESCRIPTION OF PREFERRED EMBODIMENTS

Figure 1:
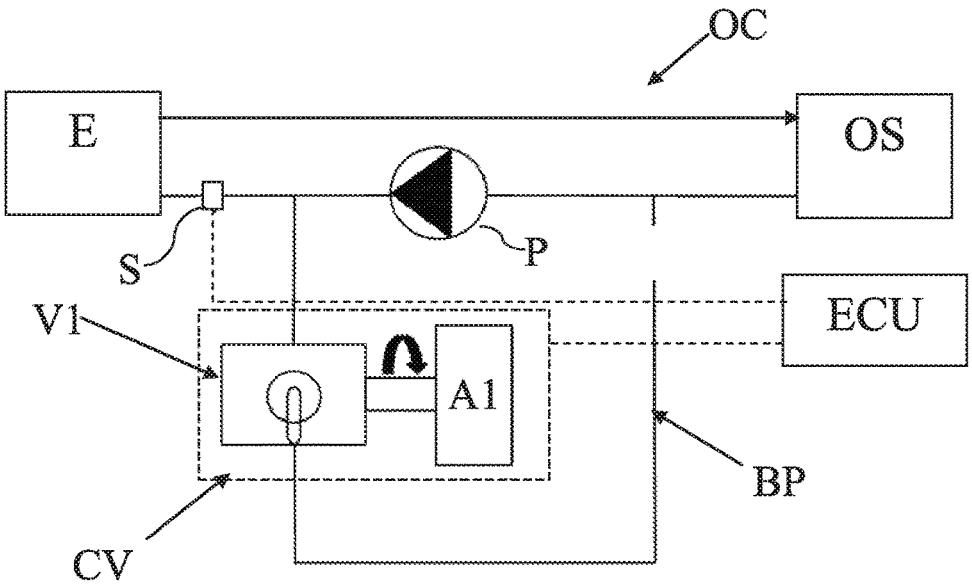
FIGS. 1 and 2 show two preferred embodiment of the present invention.
Figure 2:
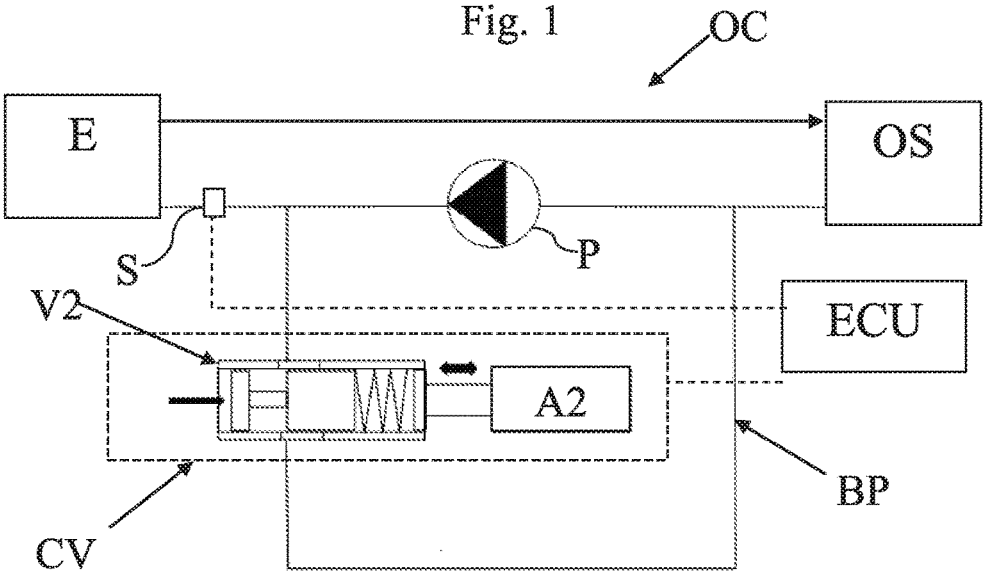

FIGS. 1 and 2 show preferred embodiments of the present invention.

A non-controllable pump P is connected to an engine oil circuit OC, preferably between the oil sump OS and the combustion engine to be lubricated/cooled, hence it pumps the engine lubricating oil from the oil sump OS towards the engine components E through a so called "main circuit", then the oil falls within the oil sump OS to be circulated continuously.

A bypass path BP connects the output door of the pump P with its input door. A controllable valve CV is arranged on the bypass path BP. Therefore, this controllable valve is a 2-ways valve.

According to a preferred embodiment of the invention, the valve is a spring loaded valve, controllable by an actuator, for example, the pre-load of the spring is controllable by the actuator.

According to another embodiment of the invention, a fixed-load-spring valve is coupled with a controllable valve.

A control unit ECU, preferably defining the same control unit controlling the combustion engine, acquires as inputs the engine speed and controls the state of the controllable valve CV in order to adapt the oil pressure, within the combustion engine, as a function of said engine speed.

Figure 3:
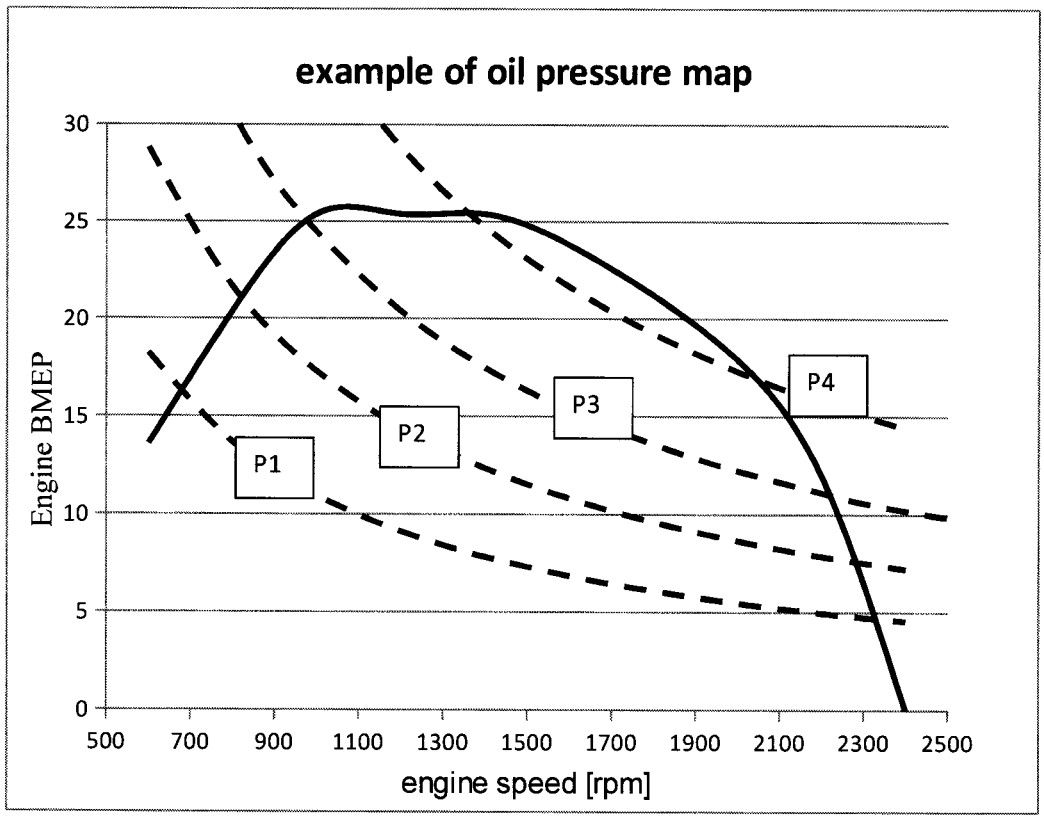
FIG. 3 show an example of map for controlling the actuated valve of the FIGS. 1 and 2.

According to a preferred embodiment of the present invention, the control unit acquires also the current BMEP and through a model base calculation or a map, calculates/extracts a reference oil pressure to be maintained within the lubricating oil circuit. FIG. 3 shows an example of map where the X-axis refers to the engine speed revolutions, the Y-axis, the BMEP and according to each of couple of values is found a curve or the closest curve indicating the optimal oil pressure. In the example curves P1 is 1 bar, P2 is 1.5 bar, P3 is 2 bar and P4 is 2.5 bar.

According to another preferred embodiment of the invention, also the oil temperature is accounted for, by the control unit, in order to calculate/extract a reference oil pressure to be maintained within the lubricating oil circuit. Therefore, the sensor S indicated in FIGS. 1 and 2 could be implemented a pressure sensor or an oil flow and eventually also a temperature sensor in order to implement closed loop control schemes.

In any case, the control unit controls the state of the controllable valve CV in order to control the engine oil pressure, namely the oil pressure in at least one point of the engine.

Preferably, FIG. 3 refers to the reference pressures measured at the main circuit of the engine, namely the duct downstream the pump P, before its subdivision into several channels. However, the map of FIG. 3 can be redrawn according to a specific measurement point within the oil circuit.

In any engine operating point, at any actual oil temperature, the oil pressure can be controlled or steered. This allows to adapt the oil pressure in general and especially to reduce the energy absorbed by the pump in order to save fuel consumption, without mandatorily introducing a variable pump that is prone to frequent failures.

As alternative to the pressure sensor, an oil flow sensor can be implemented. In such a case the FIG. 3 can be modified in order to express the oil flow curves instead of the oil pressures ones.

The figures herewith attached refer to one single non-controllable oil pump. However, the present invention can be equally implemented by using two or more separate oil circuits with at least one of them arranged according to the present invention.

According to a preferred implementation of the present invention, the present scheme is adopted at least for supplying the engine brake actuation.

The actuation of the hydraulic engine brake needs really short times, typically less than 0.8 seconds with high pressure, namely in the order of 4 bars.

If the highest pressure value of the map of FIG. 3 is compared with this value of 4 bar, it is immediately clear that the reaction of oil system pressure should be really fast.

According to the present invention, it is possible to obtain such pressure variation in less than 0.2 seconds, much quicker than it can be reached with a variable pump.

Therefore, the present invention can be advantageously implemented in connection with a variable pump.

Another advantage of the present invention is the fact that the pressure can be controlled in a so refined way, that it can be possible to reduce the impact of clearances or machining tolerances without compromising the bearings wear.

This advantage can be favorably exploited for added WHR-systems and/or power turbines, that are really sensible to lubricating issues.

The opening of the bypass path induces to reduce oil pressure in the main circuit, hence less pressure losses in oil filter and oil cooler, because the bypassed oil does not flow through this components.

Eventually, the fixed pump flow is not changed, however the superfluous oil flow is bypassed.

The difference, in terms of fuel consumption (BSFC gain) between the present solution and the implementation of a variable pump alone is negligible, but the cost of the variable pump is considerably higher and its reliability is a strong issue.

The controllable valve CV, according to the example on FIG. 1, is realized through a rotary sleeve valve V1 commanded, preferably, through a rotatable electric actuator A1, e.g. a stepped drive.

The controllable valve CV, according to the example on FIG. 2, is realized through an axial sleeve valve V2 commanded, preferably, by a linear actuator A2.

It should be clear that several kind of actuators, either pneumatic or hydraulic ones, can be implemented.

Furthermore, it should be clear that it is preferred to implement a controllable valve CV suitably to manage several opening intermediate states, or continuously variable states, rather than an ON/OFF valve.

This invention can be implemented advantageously in a computer program comprising program code means for performing one or more steps of such method, when such program is run on a computer. For this reason, the patent shall also cover such computer program and the computer-readable medium that comprises a recorded message, such computer-readable medium comprising the program code means for performing one or more steps of such method, when such program is run on a computer.

Many changes, modifications, variations and other uses and applications of the subject invention will become apparent to those skilled in the art after considering the specification and the accompanying drawings which disclose preferred embodiments thereof. All such changes, modifications, variations and other uses and applications which do not depart from the spirit and scope of the invention are deemed to be covered by this invention.

Further implementation details will not be described, as the man skilled in the art is able to carry out the invention starting from the teaching of the above description.

The invention claimed is:

1. A lubricating oil system for a combustion engine, in particular for industrial or commercial vehicles, the system comprising:

a bypass connection (BP) suitable to bypass an oil pump (P) associated to an engine oil circuit (OC);

a controllable valve (CV) suitable to adjust an amount of oil to be bypassed through said bypass connection; and a control unit (ECU) programmed to control said controllable valve (CV) as a function of a speed of the combustion engine and as a function of engine BMEP value;

wherein said control unit (ECU) is programmed to implement a run-time model-base estimator or stores a curve/map to control said controllable valve.

2. The system according to claim 1, wherein said oil pump (P) is a non-controllable type or a variable geometry type.

3. The system according to claim 1, wherein said control unit (ECU) is programmed to control said controllable valve as a function of the speed of the combustion engine and as a function of engine BMEP value and as a function of at least one of the following parameters:

oil temperature;

oil pressure;

oil flow sensor;

oil viscosity.

4. The system according to claim 3, wherein said engine oil circuit comprises sensor (S) in connection with said control unit (ECU), positioned between the oil pump (P) and the engine to acquire an oil pressure or an oil flow and eventually also an oil temperature.

5. The system according to claim 1, wherein said controllable valve comprises a rotary or sliding sleeve valve (V1, V2) associated with a rotatably or linear actuator (A1, A2).

6. The system according to claim 1, wherein said engine oil circuit (OC) is associated to an engine hydraulic braking system.

7. An engine braking system for a combustion engine, in particular for industrial or commercial vehicles, comprising a hydraulic circuit in connection with a controller for controlling an engine valve displacement in order to realize an engine braking operation, wherein said hydraulic circuit is supplied by a dedicated oil circuit provided with a lubricating oil system comprising:

a bypass connection (BP) suitable to bypass an oil pump (P) associated to an engine oil circuit (OC);

a controllable valve (CV) suitable to adjust an amount of oil to be bypassed through said bypass connection; and a control unit (ECU) programmed to control said controllable valve (CV) as a function of a speed of the combustion engine and as a function of engine BMEP value;

wherein said control unit (ECU) is programmed to implement a run-time model-base estimator or stores a curve/map to control said controllable valve.

8. A combustion engine characterized in comprising a lubricating oil system comprising:

a bypass connection (BP) suitable to bypass an oil pump (P) associated to an engine oil circuit (OC);

a controllable valve (CV) suitable to adjust an amount of oil to be bypassed through said bypass connection; and a control unit (ECU) programmed to control said controllable valve (CV) as a function of a speed of the combustion engine and as a function of engine BMEP value;

wherein said control unit (ECU) is programmed to implement a run-time model-base estimator or stores a curve/map to control said controllable valve.

9. A commercial or industrial vehicle characterized in comprising a combustion engine according to claim 8.

10. A method for adjusting an oil pressure in a lubricating oil system of a combustion engine, in particular for industrial or commercial vehicles, the method comprising the following steps:

arranging a bypass connection (BP) suitable to bypass an oil pump (P) associated to an engine oil circuit (OC);

arranging a controllable valve (CV) suitable to adjust an amount of oil to be bypassed through said bypass connection; and (i) controlling said controllable valve (CV) as a function of a speed of the combustion engine speed and as a function of engine BMEP value;

wherein said controlling step (i) is performed accounting for at least one of the following parameters:

oil temperature;

oil pressure;

oil flow sensor; and oil viscosity;

wherein said controlling step (i) is carried out through a run-time model-base estimator or through a curve/map.

11. A computer program comprising non-transitory computer program code means adapted to perform said step i of claim 10, when said program is run on a computer.

12. A non-transitory computer-readable medium having a program recorded thereon, said computer-readable medium comprising computer program code means adapted to perform said step i of claim 10, when said program is run on a computer.

* * * * *